US012181247B2

(12) United States Patent
McGrane

(10) Patent No.: US 12,181,247 B2
(45) Date of Patent: Dec. 31, 2024

(54) RETENTION BREAKING DEVICE TO BREAK RETENTION OF A GUN BY A POCKET HOLSTER WITHIN A FRONT PANTS POCKET AND ENABLE MOVEMENT OF THE GUN UNOBSTRUCTED BY THE FRONT PANTS POCKET AS THE GUN IS DRAWN

(71) Applicant: John Joseph McGrane, Cary, NC (US)

(72) Inventor: John Joseph McGrane, Cary, NC (US)

( * ) Notice: Subject to any disclaimer, the term of this patent is extended or adjusted under 35 U.S.C. 154(b) by 128 days.

(21) Appl. No.: 18/244,267

(22) Filed: Sep. 10, 2023

(65) Prior Publication Data

US 2024/0125578 A1 Apr. 18, 2024

Related U.S. Application Data

(60) Provisional application No. 63/415,344, filed on Oct. 12, 2022.

(51) Int. Cl.
*F41C 33/04* (2006.01)
*F41C 3/04* (2006.01)
*F41C 33/02* (2006.01)

(52) U.S. Cl.
CPC ..... *F41C 33/048* (2013.01); *F41C 33/0209* (2013.01); *F41C 33/041* (2013.01)

(58) Field of Classification Search
CPC ..... F41C 33/048
USPC ..... 224/238, 243, 198, 193, 192, 244
See application file for complete search history.

(56) References Cited

U.S. PATENT DOCUMENTS 814,599 A * 3/1906 Freyer ..... F41C 33/0209 224/230
1,120,190 A * 12/1914 Gaskill ..... F41C 33/0209 224/230
1,887,780 A * 11/1932 Philip ..... A45F 5/022 224/230
3,630,420 A * 12/1971 Bianchi ..... F41C 33/0227 224/193
4,485,947 A * 12/1984 Cook ..... F41C 33/0227 224/911
5,018,653 A * 5/1991 Shoemaker ..... F41C 33/045 D3/222

(Continued)

OTHER PUBLICATIONS

"Stallion Leather Concealed Carry Holsters—Front Pocket Holster" video by Patriot Outfitters (https://www.youtube.com/watch?v=xPcjvh4N1Ps); Sep. 13, 2012 (Year: 2012).*

*Primary Examiner* — Nathan J Newhouse
*Assistant Examiner* — Lester L Vanterpool
(74) *Attorney, Agent, or Firm* — Robert J. Hess; Hess Patent Law Firm

(57) ABSTRACT

A pocket gun holster is prevented from leaving a pants pocket as a gun is being drawn from the holster. An extension that is either attached or contiguous with the holster has a distal end that terminates from the mouth of the holster by more than a clearance distance and collides with an interior surface of the pants pocket as the holster and gun move in unison at the start of drawing the gun from the holster. The collision breaks retention between the gun and the holster and the clearance distance is maintained by the extension (without bending or collapsing) to enable the gun to be drawn out of the holster unobstructed by the pants pocket.

18 Claims, 15 Drawing Sheets

(56) References Cited

U.S. PATENT DOCUMENTS

| | | | | |
|---|---|---|---|---|
| 6,131,198 | A * | 10/2000 | Westrick | F41C 33/048 2/2.5 |
| 8,484,765 | B2 * | 7/2013 | French | F41C 33/0209 2/250 |
| 9,581,413 | B2 * | 2/2017 | Massaro, Jr. | F41C 33/04 |
| 10,184,755 | B2 * | 1/2019 | Moultrie | F41C 33/041 |
| 2003/0205595 | A1 * | 11/2003 | Young | F41C 33/0218 224/230 |

* cited by examiner

RETENTION BREAKING DEVICE TO BREAK RETENTION OF A GUN BY A POCKET HOLSTER WITHIN A FRONT PANTS POCKET AND ENABLE MOVEMENT OF THE GUN UNOBSTRUCTED BY THE FRONT PANTS POCKET AS THE GUN IS DRAWN

CROSS-REFERENCE TO RELATED APPLICATIONS

This patent application asserts the benefit of priority from provisional patent application No. 63/415,344 filed Oct. 12, 2022.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE

Not applicable.

BACKGROUND OF THE INVENTION

1. Field of the Invention

The present invention relates to gun holsters for concealed carry. More particularly, it relates to gun holsters for concealed carry in a front pants pocket.

2. Description of Information Known to the Inventor, Including References to Specific Documents Related to the Invention, and Specific Problems Involved in the State of Technology that the Invention is Drawn Toward With the incidence of violent crime on the rise and the reduction of police budgets in many towns and cities, more and more Americans are applying for and receiving carry permits that enable them to legally have a loaded handgun on their person in public for self-defense. Most people who carry prefer to keep their gun concealed beneath an article of clothing like a jacket or shirt or in a pocket. Although there are a number of ways to conceal carry, in shoulder holsters, in ankle holsters and in the aforementioned pocket holsters, the most popular methods of carry are what are called: 1) inside the waistband (IWB); and 2) outside the waistband (OWB). These two methods are considered by most gun experts to be superior to pocket carry because they provide a more reliable and faster draw. But there are times when a person may prefer to carry in their pants pocket because it's more convenient, more comfortable and more discrete.

Instead of having to put on a specially designed tactical belt and having to slide or clip your holster onto it, the pocket carrier simply puts the holster with the gun in it into his or her pocket and is ready to go. Instead of squeezing your gun and holster inside the waistband of your pants and feeling it pushing against your body, the pocket carrier barely notices the gun and holster when it's in their pocket. And instead of worrying all the time about others discovering that you have a gun on you when your open jacket shifts or your shirt rises up when you bend over, the pocket carrier has the ease of mind knowing that their gun is perfectly concealed at all times.

But, unfortunately, pocket carry does have its drawbacks. The size of a pocket limits the size of the gun that can be carried in it. This usually relegates pocket carriers to smaller caliber guns with less stopping power making them more vulnerable in a confrontation. Another issue is pocket carry is considered slower. Carrying in the pocket means the gun is sitting lower in the pants. So you have to reach a little further to gain purchase. Then there is the fact that pocket openings are merely slits that lay flat against the body. If you're faced with a situation that makes you feel you need to draw your gun, it's very likely you'll lose some of your coordination being in a state of extreme stress and have difficulty finding your pocket and negotiating the small slit with your fingers to gain purchase on your gun. And even if you do manage that feat, you can run into what is commonly referred to as "the monkey fist" problem. If the opening to your pocket is a little small or your hands a little too big, it may be difficult to pull the gun out after you've gained purchase on it.

But given current pocket holster designs, the biggest issue for pocket carry is the conflict it presents between safety and usability. Safety requires that a holster prevent access to the trigger of the gun before the gun is drawn to prevent inadvertent pulling of it. It also requires the holster have retention adequate to prevent the gun from falling out. Both of these requisites make it much less likely there will be a negligent discharge of the weapon. Usability, on the other hand, requires the holster release the gun when you draw, thereby giving you access to its trigger so you can fire it. This means that a safe holster has to have both retention and the ability to break it when you draw.

This is generally not a problem for inside the waistband and outside the waistband holsters for the simple fact that they can be strongly anchored to your pants. Both outside the waistband and inside the waistband holsters are generally secured to thick belts via strong metal or plastic clips. There are also "clipless" inside the waistband holsters with nonslip exteriors that are well secured simply by the pressure exerted by the user's body against the waistband of their pants. Pocket holsters, on the other hand, cannot be anchored to the pants and therefore must have a means of breaking the holster's retention during the drawing process.

Current soft Nylon fabric pocket holsters attempt to stay in the pocket when the gun is drawn by securing themselves to the interior walls of the pocket lining by means of a sticky or non-slip rubbery exterior of some sort. This only works reliably if there is virtually no retention in the holster. If there is any noticeable retention, this sort of holster will simply pull the user's pocket inside out as it comes out still attached to the gun. So this sort of holster is considered unsafe by many experts because it either has no retention or it doesn't release the gun, sometimes both.

Current Kydex or leather pocket holsters, which generally have adequate retention, employ a hook shaped element designed to catch the back of the pocket as both the holster and the gun are exiting it. This is problematic because the hook is situated below the handle of the gun and usually doesn't extend outward any further than the handle itself. When you add the user's hand on the handle of the gun to the equation the hook is actually recessed a bit. This makes it rather difficult to get the gun out of the pocket and at the same time get the hook to catch. The user has to draw with an unnatural backward motion, raking the gun and holster against the back of the pocket in order for the hook to catch. The likelihood that this will work depends on how much distance there is between the handle and the hook and how fast the user draws. Some of these kinds of holsters don't leave enough space, a space that only gets smaller when the user wraps his or her fingers around the handle to draw.

This hook design, at least the more popular one that hooks the back of the pocket, has a fundamental flaw: the hook is situated directly below the grip of the gun with a fairly small space between them. It's a space made even smaller by the user's fingers when he wraps them around the grip to draw. This results in a very small window of opportunity for the user to catch the pocket with the hook as the gun and the holster are coming out of the pocket. And the faster one attempts to draw, the smaller that window is. The lip of the pocket has to find itself in that small space at some point in the draw for the hook to engage it. So, the user of this type of pocket holster has to rake the gun, with the holster still attached to it, in a backward fashion when they draw in order to get the hook to snag. With practice this can be made to work most of the time, but not every time. Aside from this issue, because this design requires the user to draw in a backward fashion, it takes slightly more time to get the gun on target when split seconds could mean the difference between life and death.

There are a few Kydex holster models where in addition to having a hook in the back they also have a small protrusion in the front emanating from the mouth of the holster for catching the front of the pocket. This can also be problematic in that it requires the user to draw with a slightly forward motion which can result in the butt of the gun getting hung up in the small space in front of the opening of the pocket preventing not just the holster from coming out, but the gun as well.

Some current Kydex holsters have what is called a thumb press which enables the user to break the retention of the holster with their thumb prior to drawing. This works quite well if the user has anticipated the threat and already has their hand on the gun when it materializes. But if the user's hand isn't in the pocket, it's just an additional step that needs to be performed without mishap under extreme stress in order to draw successfully.

There are Kydex holsters that provide ample space between the hand and the hook shaped element. But in order to gain this space, the hook shaped element has to be way down at the bottom of the holster, which means nearly the entire gun and holster must exit the pocket before the hook can catch and the retention be broken. This makes for a clumsier, slower presentation of the gun.

Pocket holsters provide for a means for breaking the pocket holster's retention on the gun so the holster releases it when the user attempts to draw. If the holster's retention is not broken during the draw the holster will come out of the pocket with the gun continuing to cover the gun's trigger and thus requiring additional steps be taken by the user before the gun can be brought to bear on a threat.

According to gun safety experts all gun holsters should have retention. The holster should retain the gun, prevent it from falling out inadvertently during physical activity like running, jumping, falling down, etc. Guns can go off by themselves when they hit the ground posing a danger to the owner and those around him. Having the gun fall out in a public setting, like a restaurant, when for example you sit down, can also result in a degree of embarrassment and perhaps other undesirable social consequences. Also, should you be knocked to the ground by an assailant, you don't want the gun to come flying out of your holster thereby losing access to it to defend yourself.

The second and related rule of safety is that the holster must release the gun when the owner goes to draw it. Obviously, If the holster doesn't release the gun when you need it, the holster defeats the purpose of carrying a gun in the first place. So, all holsters with retention, some don't have it, must have a means of breaking that retention built into them or attached to them.

With guns that are carried inside the waistband (IWB), the holster's retention is broken by a belt clip. The clip, which is attached to the holster with screws, holds the holster securely on your belt when you draw. The same is true for guns carried outside the waistband (OWB). But with guns that are carried in the front pocket of your pants, an increasingly popular method of carry, a hooked wing at the base of the holster breaks the retention by snagging the back lip of the of the mouth of the pocket. There are a very few examples of pocket holsters where there is also a small, curved section of the mouth of the holster that juts out in front slightly designed to catch the front lip of the pocket. In either case, the drawer must be consciously aware of how they're drawing, either backward or forward, in order to make sure the holster does what it's supposed to, release the gun. This is the current state of the art when it comes to pocket holsters.

Conventional holsters may be made of natural materials such as leather or made from manmade materials such as an injection-molded or thermoplastic materials, namely, Kydex, Boltaron, Acrylonitrile Butadiene Styrene (ABS) or nylon or made from a hybrid of a soft backing (leather) and hard shell (Kydex).

It is desired to improve presentation of the drawing out of a gun from a pocket holster made of natural or manmade material or of a hybrid by breaking retention of the gun by the holster in a manner that allows the drawing out of the gun from the holster to be carried out unobstructed by the pocket.

SUMMARY OF THE INVENTION

My invention seeks to overcome the limitations described above by allowing for both secure retention and a quick, reliable, natural draw of a handgun from a front pants pocket. It accomplishes this by means of a unique holster attachment made from a flat piece of hard plastic, such as Kydex, that is shaped similar to a backward "L" detachably attached to either the front or back of the holster by Chicago screws or glue-backed fastener strips such as Velcro or 3M Dual-Lock, or by any other method known to those practiced in the art. The uppermost part of the attachment extends above the butt of the gun as it rests in the holster. This attachment can be affixed to a current pocket holster, an IWB holsters or a particular kind of OWB holster known as a paddle holster thus converting them into superior pocket holsters.

When drawing from a pants pocket with a holster that has the present invention attached, the uppermost part of the invention collides with the top of the pocket that is just in front of the pocket opening which stops the upward movement of the holster breaking it's hold on the gun and keeping the holster in the pocket. Thus, the user is able to draw his or her gun using a natural vertical drawing motion that is quicker, cleaner and more reliable than current pocket holsters.

My invention doesn't rely on a snag member or hook of any kind. Instead, the invention relies on a backwards "L" shaped piece of flat or contoured plastic that can be attached on either side of a holster, by means of screws or some version or other of fastener tape like Velcro or 3M Dual-lock. In contrast, US design patent no. D822381S1, whose contents are incorporated herein by reference, exemplifies the construction of a pocket holster having a snag member or hook (towards the bottom) adapted to retain the holster within the pocket as a pistol magazine is withdrawn by hooking or snagging the snag member or hook against a section of the pocket to catch into the interior of the pocket.

What is unique about the device is the way it breaks the retention of the pocket holster. The vertical element of the "L" sticks up about an inch and a quarter above the butt of the gun as it rests in the holster. It is this part of the "L" that engages with the top of the pants pocket, when the gun is drawn. It's this vertical element pushing against the pants that stops the upward movement of the holster, thus breaking its retention on the gun. The horizontal portion of the "L" also extends beyond the dimension of the holster by a couple of inches. The stem and the arm of the "L" taper toward their tips in directions away from the corner where the stem and the arm extend away from, although the stem may have a proximal portion adjacent the corner that enlarges followed by a distal portion that tapers.

The use of a horizontal element, however, is not unique for use with pocket holsters. Most if not all pocket holsters have some sort of horizontal element at their base to keep the holster and gun vertically oriented. Without this horizontal element the gun and holster will turn clockwise when you draw, if you're right-handed, and prevent the gun from coming out of the pocket. This element also helps to obscure the outline of the gun in the pocket, preventing what is known as printing.

With my inventive configuration, the element that breaks the retention of the holster is higher in the pocket in relation to the holster. As a consequence, it breaks the retention of the holster at an earlier stage in the draw making for a cleaner draw. On the other hand, the current hook design, which is lower in relation to the rest of the holster, doesn't engage the pocket to break the holster's retention until roughly half the holster is already out of the pocket. This is why current holsters usually end up sitting half-way out of the pocket or on the ground after the draw.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE INVENTION

Various embodiments and aspects of the invention will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present invention.

Figure 1:
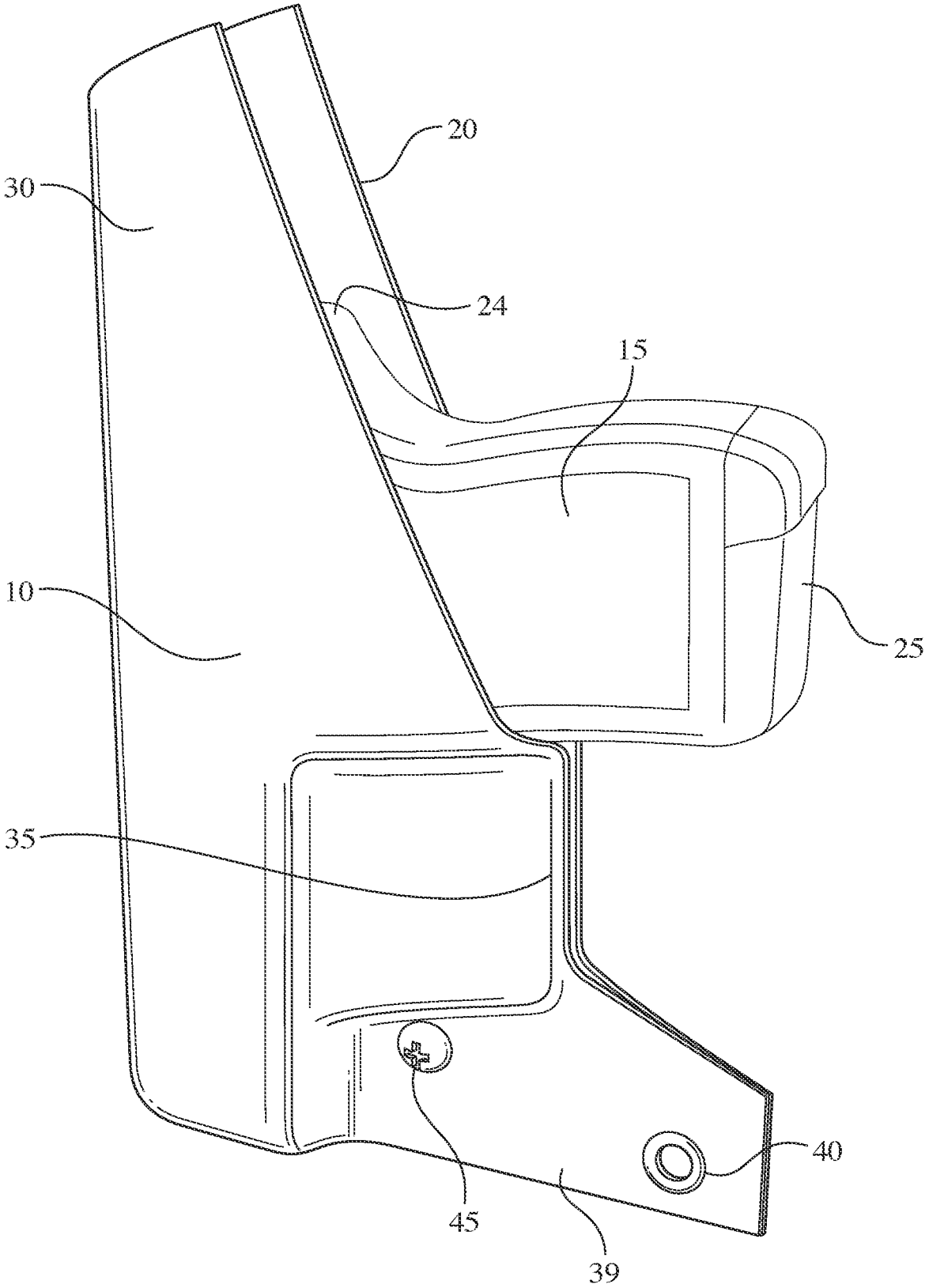
FIG. 1 is an isometric view of a dual-side extension embodiment of the invention that extends forward from both sides of a conventional Kydex holder that is retaining a gun.

FIG. 1 illustrates a perspective view of a Kydex embodiment of the present holster invention. A gun 15, which is not part of the present invention, rests in a mouth 20 of a holster 10. The overall orientation of the holster invention shown may be considered an upright position, which would be its relative position inside a front pants pocket when the wearer is in a standing position.

The holster 10 includes a trigger guard 35, which maintains retention of the gun 15 within the holster 10. The retention can withstand manual shaking of the holster 10 back and forth sideways or up and down without the retention breaking. The mouth 20 is part of an extension 30 of the holster that tapers as the extension 30 extends away from the trigger guard 35 and rises to a height of at least one inch above the butt 24 or the handle 25 of the gun 15. The extension 30 terminates at a distal end. The extension 30 is made of a sturdy material that is resistant to bending, breakage and collapse under manual force such as a conventional. hard, plastic material.

As a user attempts to draw the gun 15 out of the holster 10, the user exerts a manual force that causes upward movement of the holster 10 and eventually results in the distal end of the extension 30 pushing against the inside of the front of the user's pants pocket. At the point at which the front of the user's pants pocket can be pushed upward no further by the distal end of the extension 30 under the manual force, the continued upward movement of the holster 10 is stopped, thereby breaking the retention of the holster 10 on the gun 15 and enabling the gun 15 to be drawn unobstructed out of the holster 10.

It is the molding of the Kydex around the trigger guard 35 that produces most of the holster's retention. Also shown is a flat, side element 39 directly beneath the handle 25, which is common to most pocket carry holsters to hide the outline of the gun 15 in the pocket. On the side element 39 can be seen rivets or eyelets 40 that are used to hold the holster 10 together and a screw 45 that is used to tighten or loosen the holster's 10 retention on the gun 15.

Figure 2:
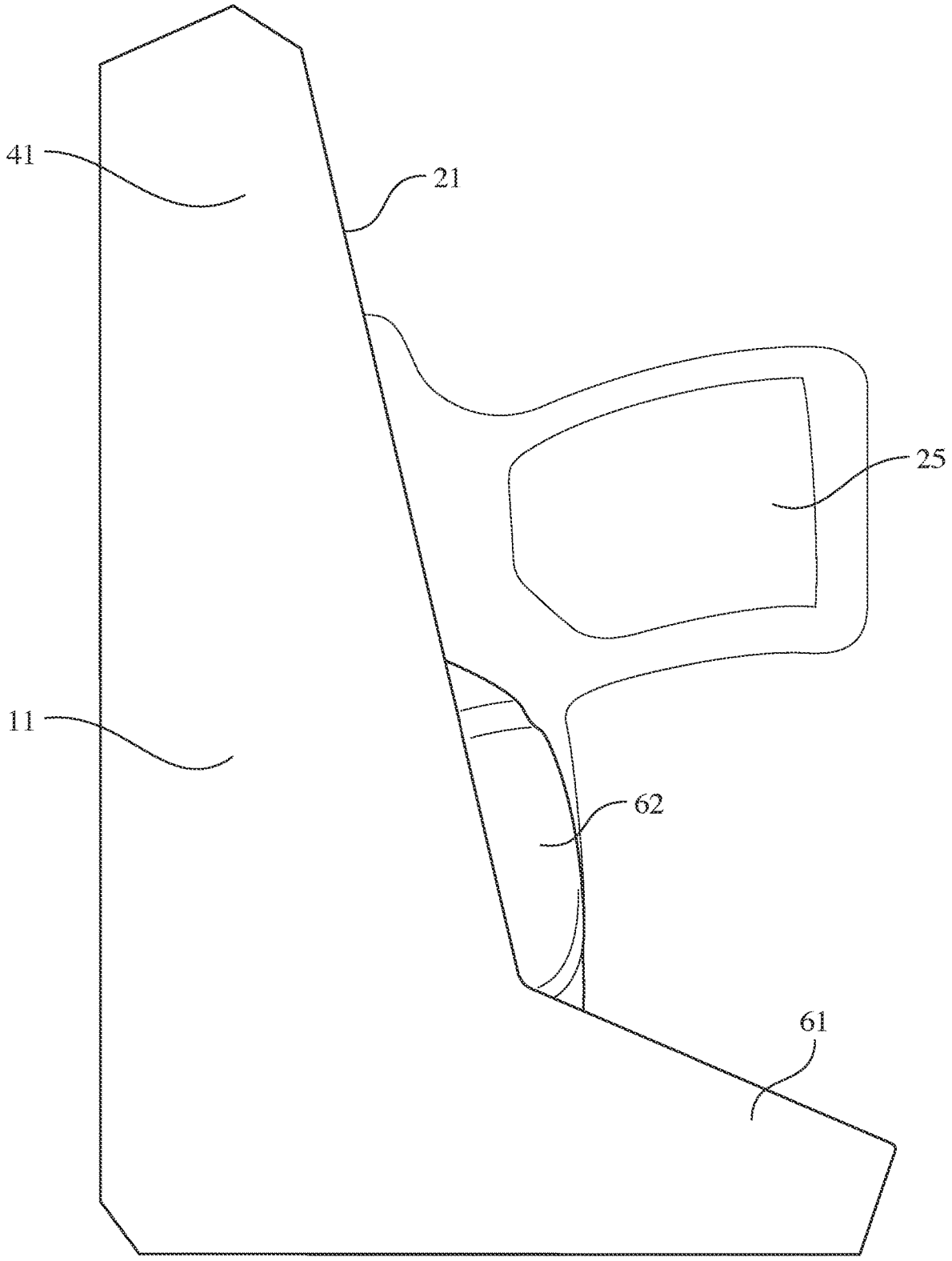
FIG. 2 is a side view of an unslotted, L-shaped attachment embodiment of the invention whose stem and arm taper away from each other and that is secured to a hard plastic holster, which retains a gun.

FIG. 2 illustrates a side view of a retention-breakage attachment 11 of the present invention with the gun handle 25 protruding from the mouth (hidden from view) of a holster (hidden from view other than the trigger guard 62). The retention-breakage attachment 11 has an L-shape that includes a stem 41 and an arm 61, which both taper away from a corner region between them that the stem and arm portions 41, 61 extend outward obliquely from each other. The retention-breakage attachment 11 may be made of a material resistant to its shape altering under a manual force, i.e., resistant to bending, breakage, and collapse. Some suitable materials for the retention-breakage attachment 11 include hard-plastic, reinforced plastic and reinforced leather.

Figure 3:
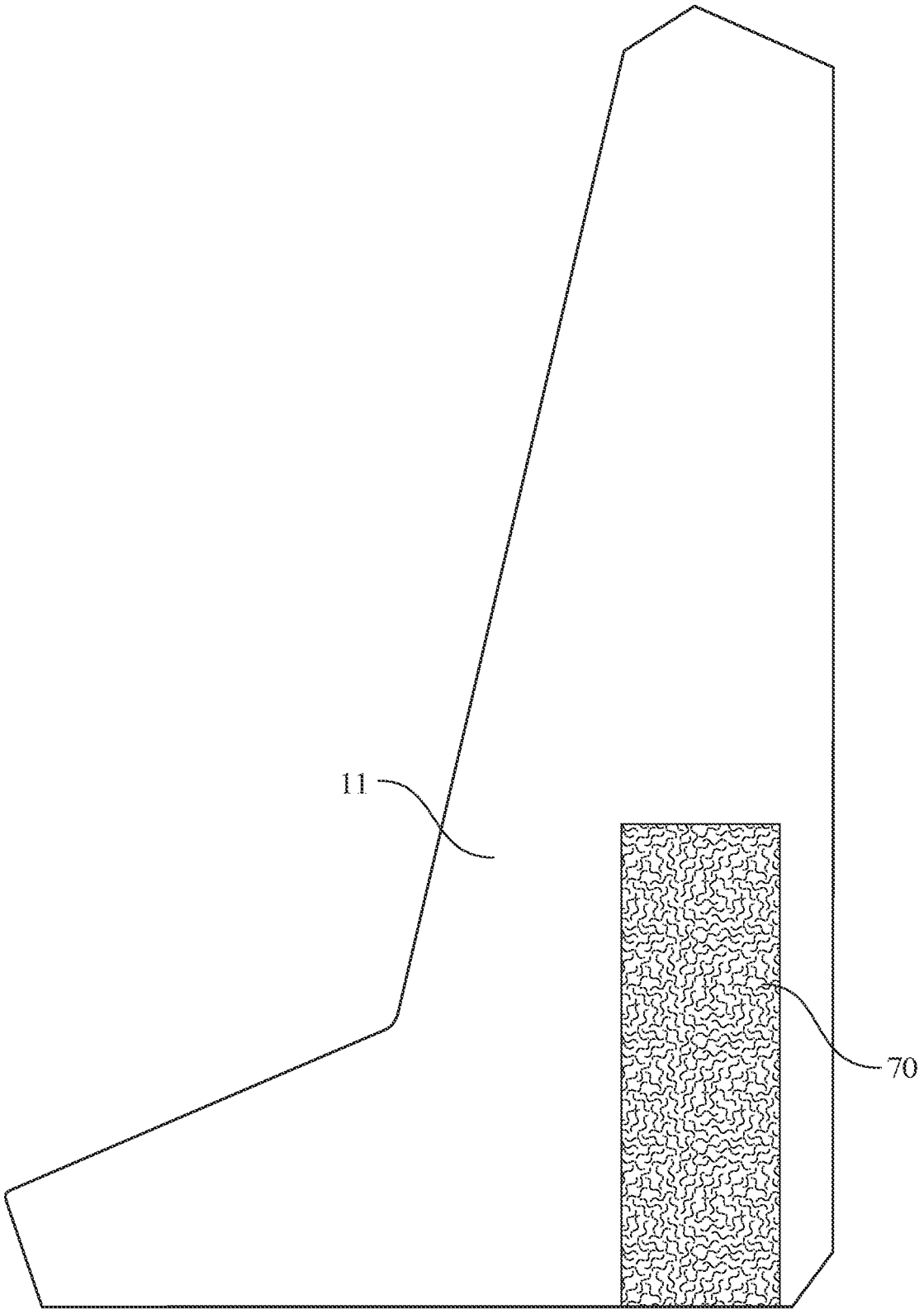
FIG. 3 is an opposite side view of the unslotted, L-shaped attachment embodiment of FIG. 2 that reveals a strip of fastener tape that attaches to a compatible fastener tape on the holster.

FIG. 3 illustrates an opposite side view of the retention-breakage attachment 11 of FIG. 2 upon which a strip of fastener tape 70 is glued to enable retaining engagement to a complementary fastener tape on the holster. The holster may be made, for instance, of a hard plastic, leather or nylon. The fastener tape may be fibrous hooks and loops (such as that sold under the tradename VELCRO) that have the hooks releasably engage the loops or may be mushroom-shaped heads (hemispheres atop a smaller diameter cylinder) that releasably engage each other as one mushroom-shaped head is inserted head first between a pair of mushroom-shaped heads so that the flat surfaces of the underside of adjacent hemispheres touch (such as that sold under tradename 3M Dual-Lock).

Figure 4:
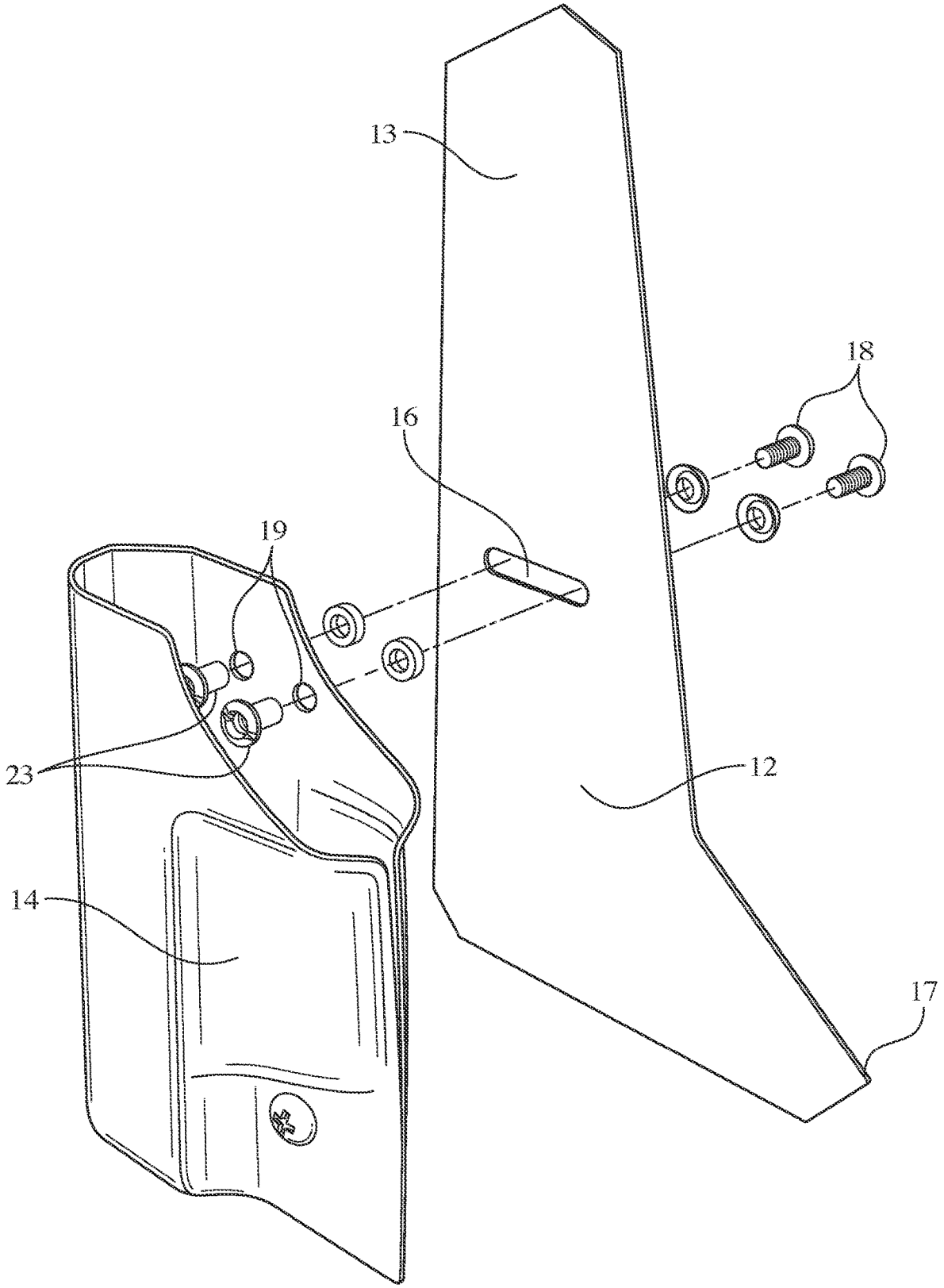
FIG. 4 is an exploded view of a slotted, L-shaped attachment embodiment of the invention whose stem and arm taper away from each other and that is to be secured to a conventional hard, plastic holster.

FIG. 4 illustrates an exploded view of an assembly in accordance with an embodiment of the invention. A retention-breakage attachment 12 is to attach to a conventional Kydex holster 14. The orientation shown is that of an upright position when placed within a front pants pocket whose wearer is standing. The retention-breakage attachment 12 differs from the retention breakage attachment 11 of FIGS. 2 and 3 by having a horizontal slot 16 instead of a strip of fibrous loop and hook material. There are a pair of holes 19 spaced apart in the conventional Kydex holster 14. It is through this pair of holes 19 that a pair of screws 18 pass to connect with two threaded nuts 23. Additional hardware, such as pairs of washers, are positioned on opposite sides of the horizontal slot 16 through which pass respective stems of the pair of screws 18 before ends of the pair of screws 18 are threaded into the threaded nuts 19. The retention-breakage attachment 12 may be made of a material resistant to its shape being affected under a manual force, i.e., resistant to bending, breakage, and collapse. Some suitable materials for the retention-breakage attachment 12 include hard-plastic, reinforced plastic and reinforced leather.

The extension element 13 of the retention-breakage attachment 12 extends upward significantly higher than the lower side 17 of the attachment and significantly higher than the conventional Kydex holster 14. The lower side 17 of the L-shaped attachment embodiment 12 is several inches lower than the mouth of the holster where the handle of the gun protrudes, thus affording the user's fingers room to grasp the handle of the gun.

Figure 5:
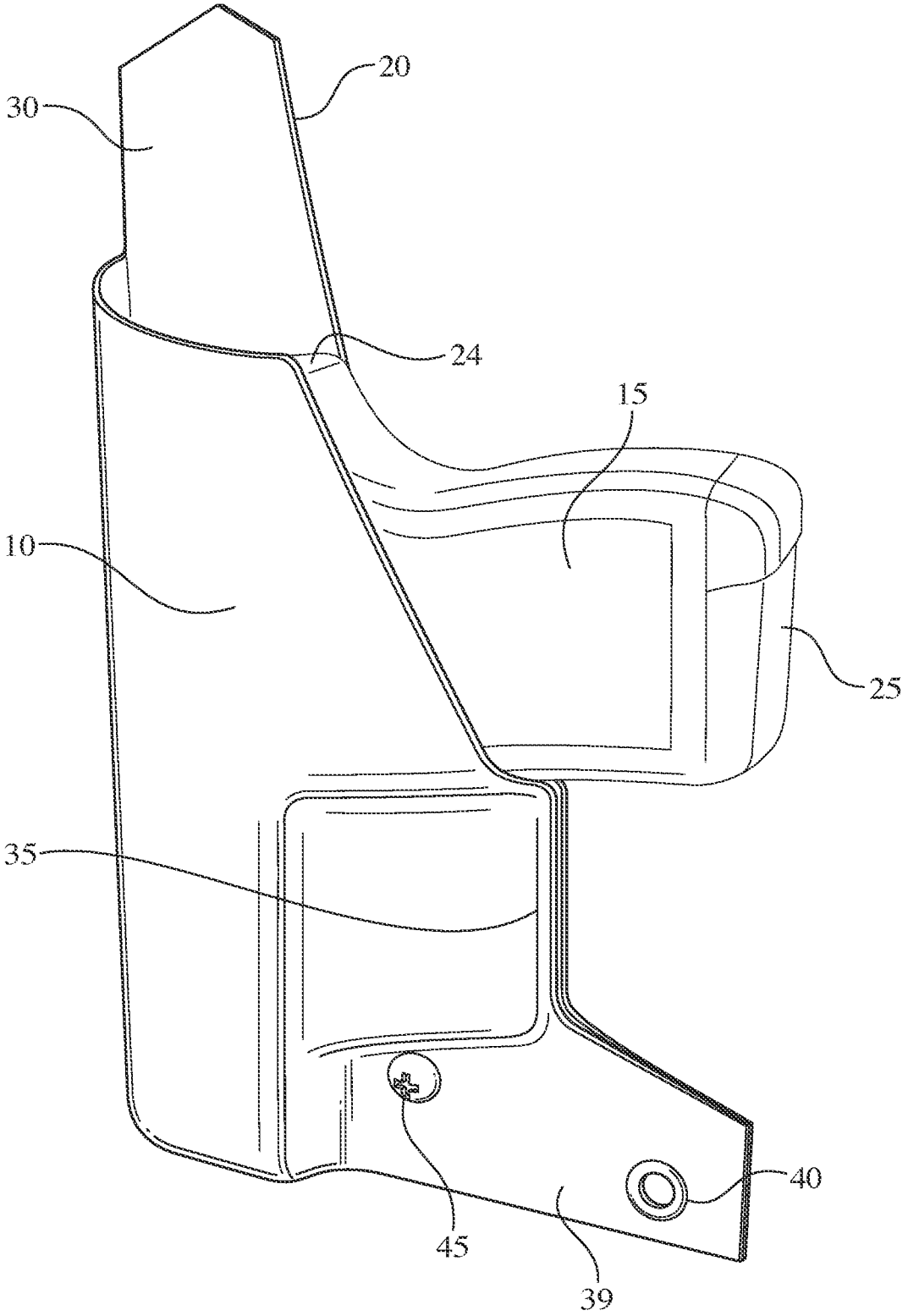
FIG. 5 is an isometric view of a single-side extension embodiment of the invention that extends forward from a single side of the conventional Kydex holder that retains a gun.

FIG. 5 illustrates a perspective view of a further Kydex embodiment of the present holster invention and its relationship to a gun 15, which altogether are shown in an upright position as they would be within a front pants pocket when worn by a wearer standing on their feet. The gun 15, which is not part of the present invention, rests in the mouth 20 of the holster 10. In a like manner to that of the embodiment of FIG. 1, the mouth 20 is part of an extension 30 of the holster that tapers as the extension 30 extends away from the trigger guard 35 and rises to a height of several inches above the butt 24 or the handle 25 of the gun 15. The extension 30 terminates at a distal end. The rest of the discussion regarding the embodiment of FIG. 1 applies equally to the embodiment of FIG. 5, but with the structural difference being that for the embodiment of FIG. 5, the extension 30 extends upward on just one side from the holster 10 rather than from both sides. The extension 30 may be made of a conventional, hard, plastic material that is resistant to bending, breakage and collapsing under manual force.

Figure 6:
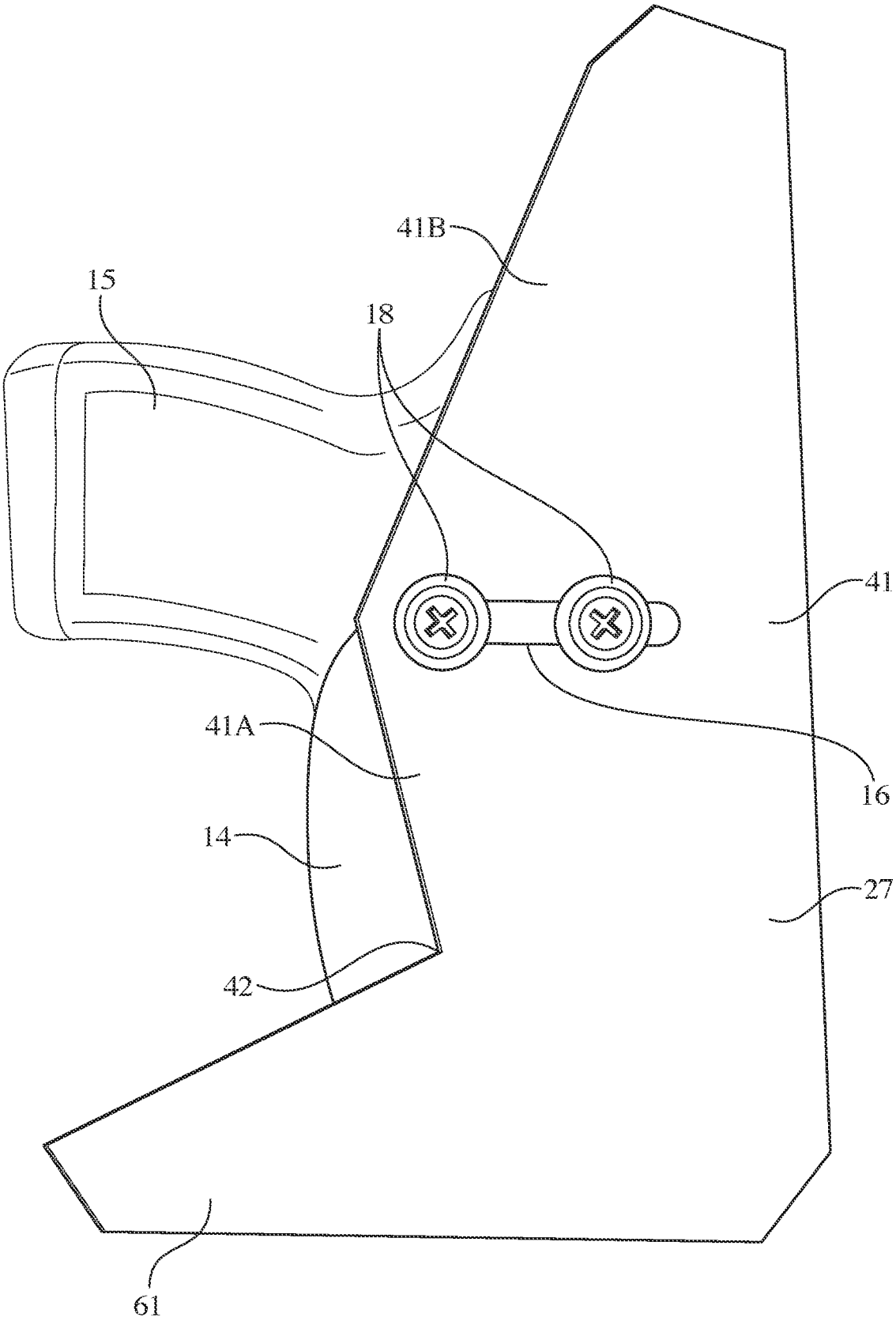
FIG. 6 is a side view of a slotted, L-shaped attachment embodiment of the invention that is secured with fasteners that extend into a horizontal slot of the L-shaped attachment to fasten to a conventional, hard plastic holster. The L-shape has a stem and an arm with the arm tapering as it extends away from the stem. The stem has a proximal portion that expands at it extends away from the arm and has a distal portion that tapers as it extends away from the arm.

FIG. 6 illustrates a side view of a retention-breakage attachment 27 secured to a conventional, hard plastic (e.g. Kydex) holster 14 via a pair of screws 18 that pass through a horizontal slot 16 in the base of the retention-breakage attachment 27. The gun 15 is placed in the holster 14, whose trigger guard retains the gun 15 within the holster 14. While the retention-breakage attachment 27 can be considered to have an L-shape, the L-shape differs from that of the L-shape of the retention-breakage attachment 11 of FIGS. 2 and 3 by having a widening portion 41A in addition to a tapering portion 41B. the widening portion 41A extends from a region at a corner 42 that is between the arm 61 and the widening portion 41A with the tapering portion 41B being more distal from the corner 42 than is the widening portion 41A. The arm 61 extends obliquely from the region of the corner 42 relative to that of the widening portion 41A.

Figure 7:
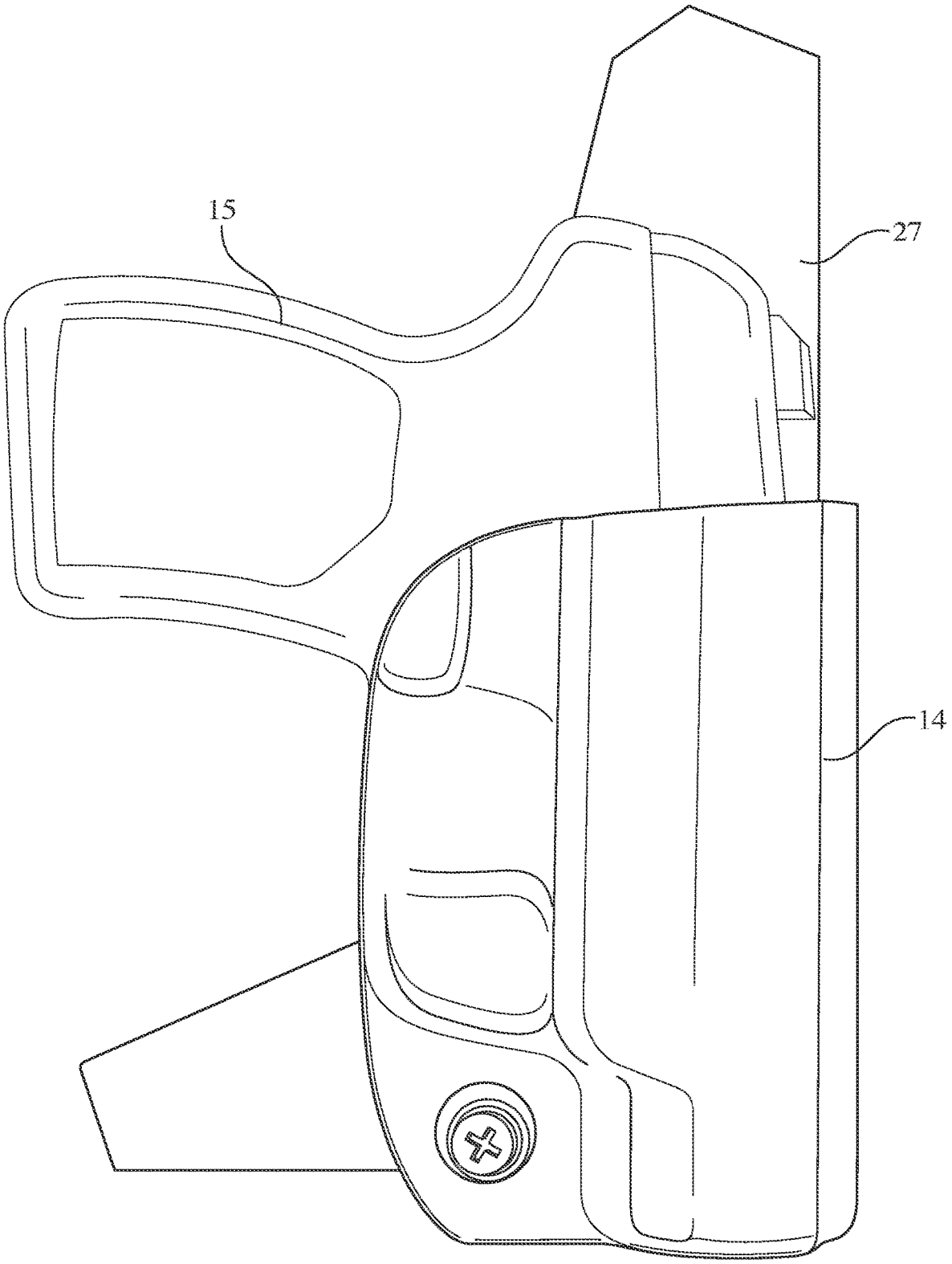
FIG. 7 is an opposite side view of the slotted, L-shaped attachment embodiment of FIG. 6.

FIG. 7 illustrates the reverse view of FIG. 6 with the retention-breakage attachment 27 shown behind a hard plastic (e.g. Kydex) holster 14 into which is retained the gun 15. A trigger guard is provided to maintain the retention of the gun 15 within the holster 14 such that the retention can withstand manual shaking of the holster 14 back and forth sideways or up and down without the retention breaking from the manual shaking.

Figure 8:
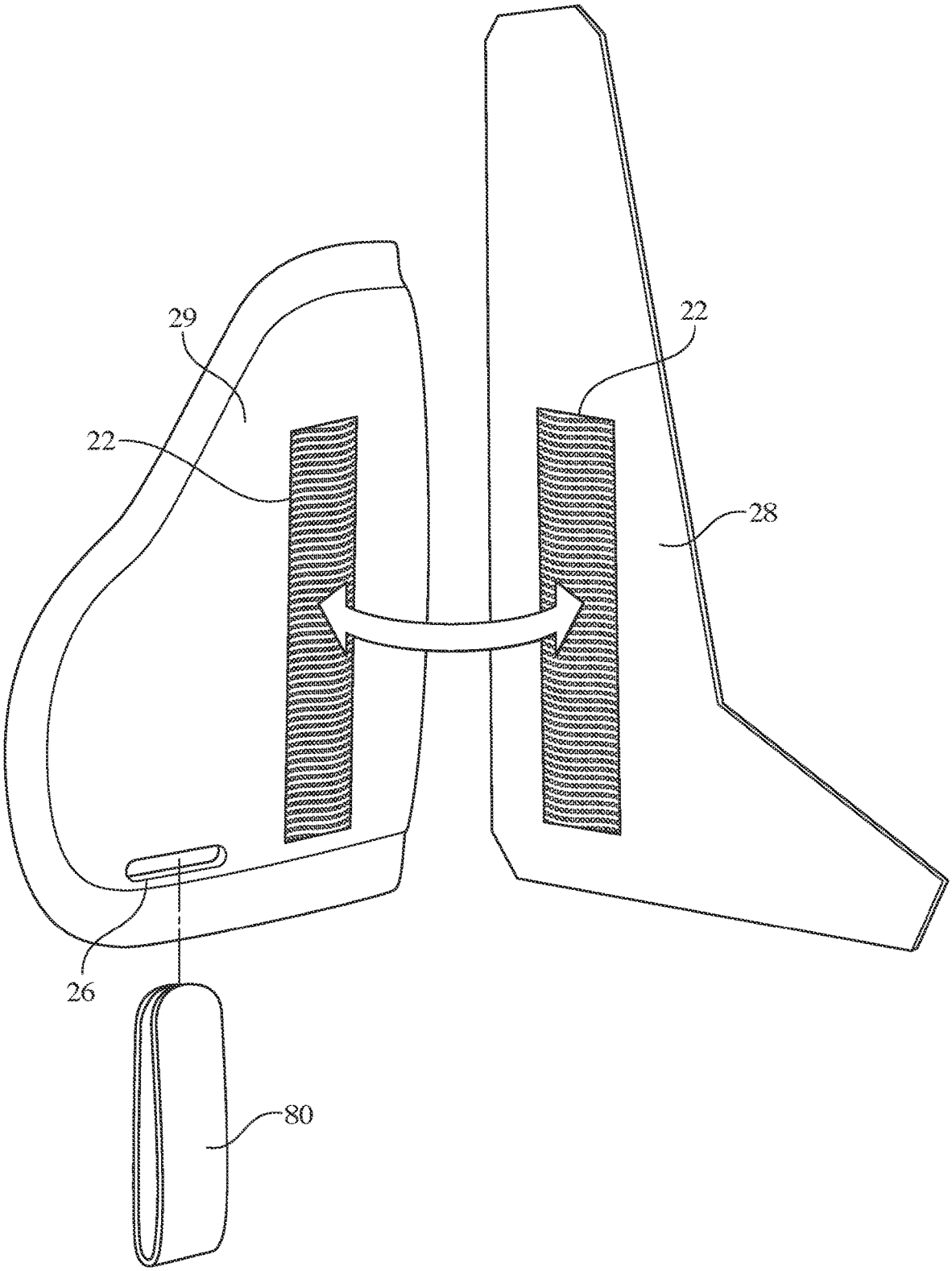
FIG. 8 is an exploded view of an unslotted, L-shaped attachment embodiment whose stem and arm taper away from each other and of a clip. They are secured to a soft holster having fastener tape, which is compatible with fastener tape on the unslotted, L-shaped attachment to releasably retain them to each other. The clip enters a slot in the soft holster and presses against a trigger region of a gun when the gun is placed into the soft holster.

FIG. 8 illustrates how a retention-breakage attachment 28 of the present invention can detachably attach to a holster 29 whose material is soft nylon/neoprene. Such is accomplished by means of opposing strips of fastener tape 22 that are adhered to both the holster 29 and the retention-breakage attachment 28 by means of a glue backing and that interlock by means of thousands of mushroom head shaped stems when the retention-breakage attachment 28 is brought together with the holster 29. It also shows a clip 80 that is passed through a slot 26 at the base of the holster 29 and which creates retention in holster 29 by attaching to the gun, not shown, by means of the trigger guard, also not shown. The retention-breakage attachment 28 has an L-shape with its arm extending obliquely from the stem of the L-shape and with both the stem and the arm tapering as they extend away from each other. The clip 80 maintains the retention of the gun 15 within the holster 29 such that the retention can withstand manual shaking of the holster 10 back and forth sideways or up and down without the retention breaking from the manual shaking. The retention-breakage attachment 28 may be made of a material resistant to its shape being altered under a manual force, i.e., resistant to bending, breakage, and collapse. Some suitable materials for the retention-breakage attachment 28 include hard-plastic and reinforced leather.

Figure 9:
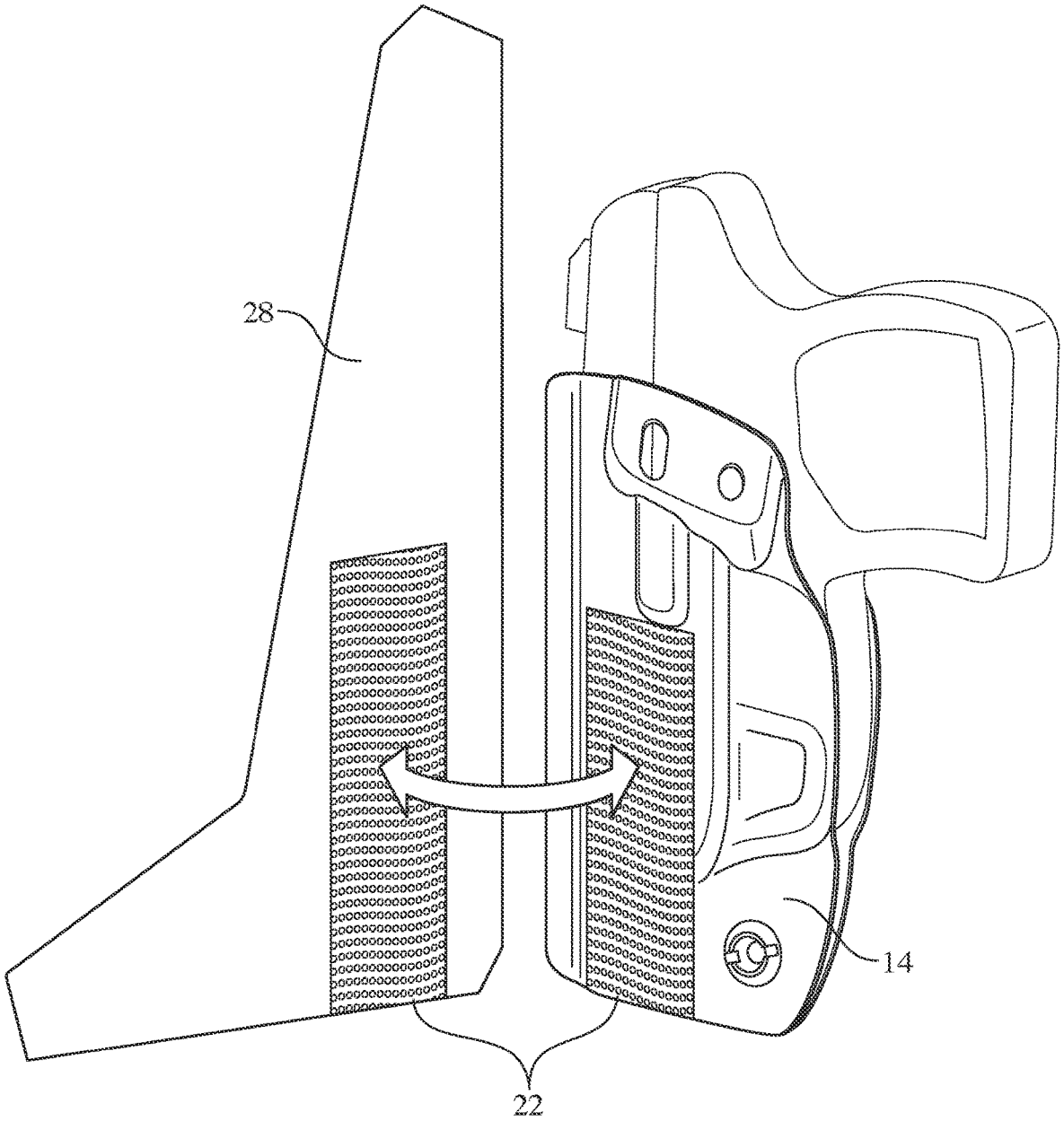
FIG. 9 is an exploded view of an unslotted L-shaped attachment embodiment that is secured to a hard, plastic holster via complementary fastener tape on each.

FIG. 9 illustrates how the retention-breakage attachment embodiment 28 of the present invention can detachably attach to a hard plastic (e.g. Kydex) holster 14 by means of opposing strips of fastener tape 22 that are adhered to both the holster 14 and to the retention-breakage attachment 28 by means of a glue backing and that interlock by means of many (perhaps thousands) of mushroom head shaped stems when the attachment embodiment 28 is brought together with the holster 14.

Figure 10:
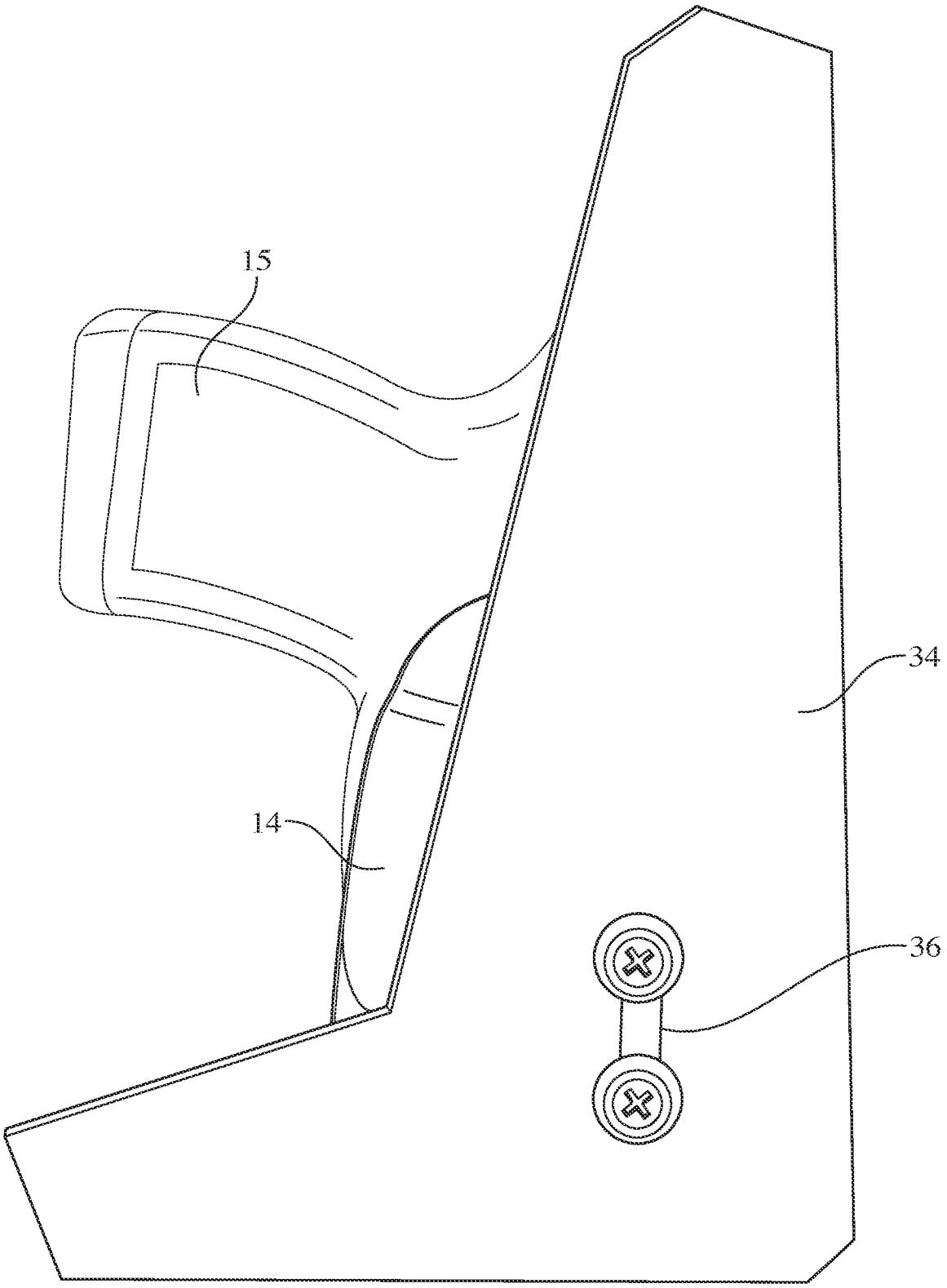
FIG. 10 is a side view of a slotted, L-shaped attachment embodiment whose stem and arm taper away from each other and that is secured to a hard, plastic holster with fasteners that extend through the vertical slot of the L-shaped attachment.

FIG. 10 illustrates a side view of one method of detachably attaching the attachment embodiment 34 of the present invention to a hard plastic (e.g. Kydex) holster 14. This version of the attachment embodiment 12 of the present invention has a vertical slot 36 and through which screws 18 pass to connect with threaded nuts, not shown, that pass through holes, not shown, in the holster 14.

Figure 11:
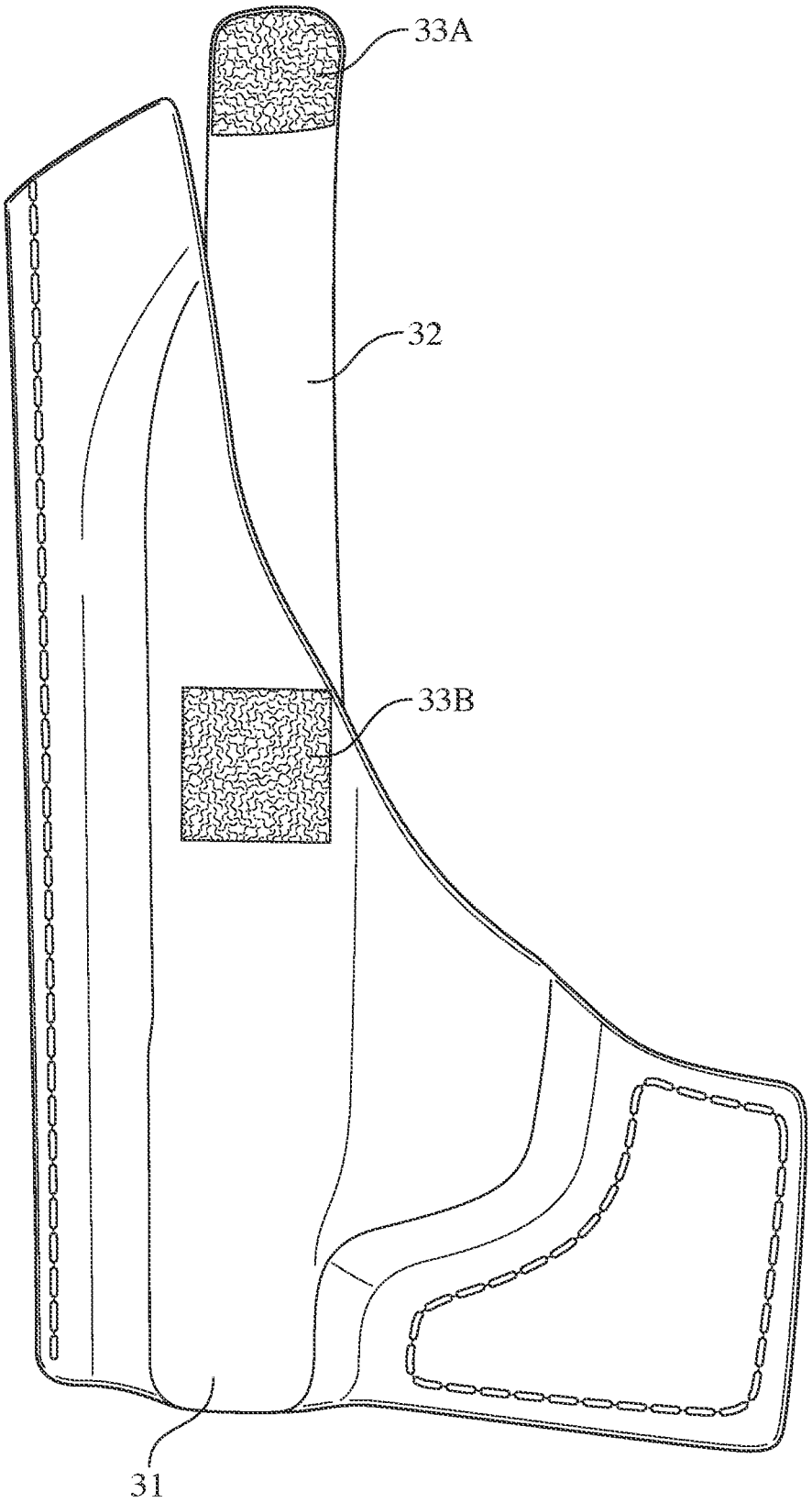
FIG. 11 is side view of a leather holster with extension and loose strap in accordance with another embodiment of the invention.

FIG. 11 illustrates a side view of a leather holster embodiment of the present invention that has a leather retention strap 32 with a fibrous hook material 33A on its end that is configured to mate with a fibrous loop material 33B glued or stitched to the side of a leather holster 31. The strap 32 is shown in an open, non-retaining position.

Figure 12:
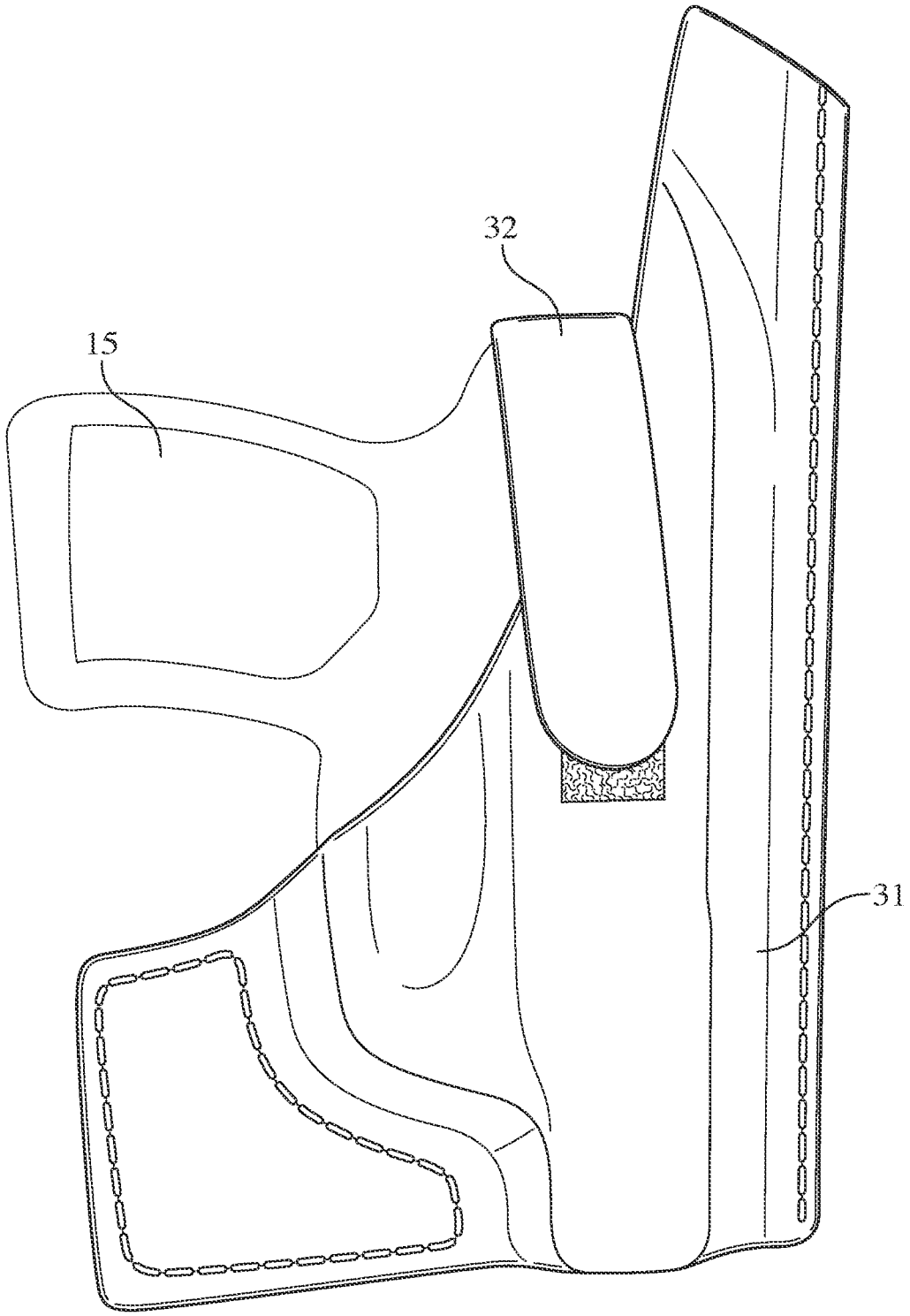
FIG. 12 is the side view of FIG. 6 but with the strap retained via fastener tape so that the strap presses from outside against a vicinity of where the gun trigger is retained in the leather holster.

FIG. 12 illustrates a side view of a leather holster embodiment of FIG. 11 to depict the leather retention strap 32 in the closed, retaining position while the gun 15 is retained within the leather holster 31 by the strap 32 in the closed, retaining position. The leather holster embodiment includes a base in which the gun (not shown) is placed and an extension that tapers to a distal end. Preferably, the distal end is strengthened so that when its distal end collides with the top of a front pants pocket, the extension retains its shape and does not collapse or bend because of the manual force applied when raising the holster to draw the gun out of the leather holster embodiment.

The closed strap 32 maintains the retention of the gun 15 within the leather holster 31 such that the retention can withstand manual shaking of the leather holster 31 back and forth sideways or up and down without the retention breaking from the manual shaking.

With respect to all of the embodiments, additional slots, both horizontal and vertical, may be added to any of the attachment embodiments to accommodate various styles of inside-the-waistband (IWB) holsters. Some IWB holsters have what are called "tuckable" belt clips that enable the user to tuck their shirt in over the holster inside their waistband for greater concealment. The holsters that accommodate these kinds of clips have holes (for screws) that are aligned vertically instead of horizontally. The holes are also usually lower down on the holster than the holes aligned horizontally.

With respect to those conventional pocket holsters that do not break retention of the holster until the gun is mostly out of the pocket, such contrasts with that of the present invention for which retention is broken while the gun is mostly still in the pocket. As a result, the present invention improves presentation over that of those conventional pocket holster. Presentation is a term used in the industry to mean drawing and pointing the gun at the target or threat.

Figure 13:
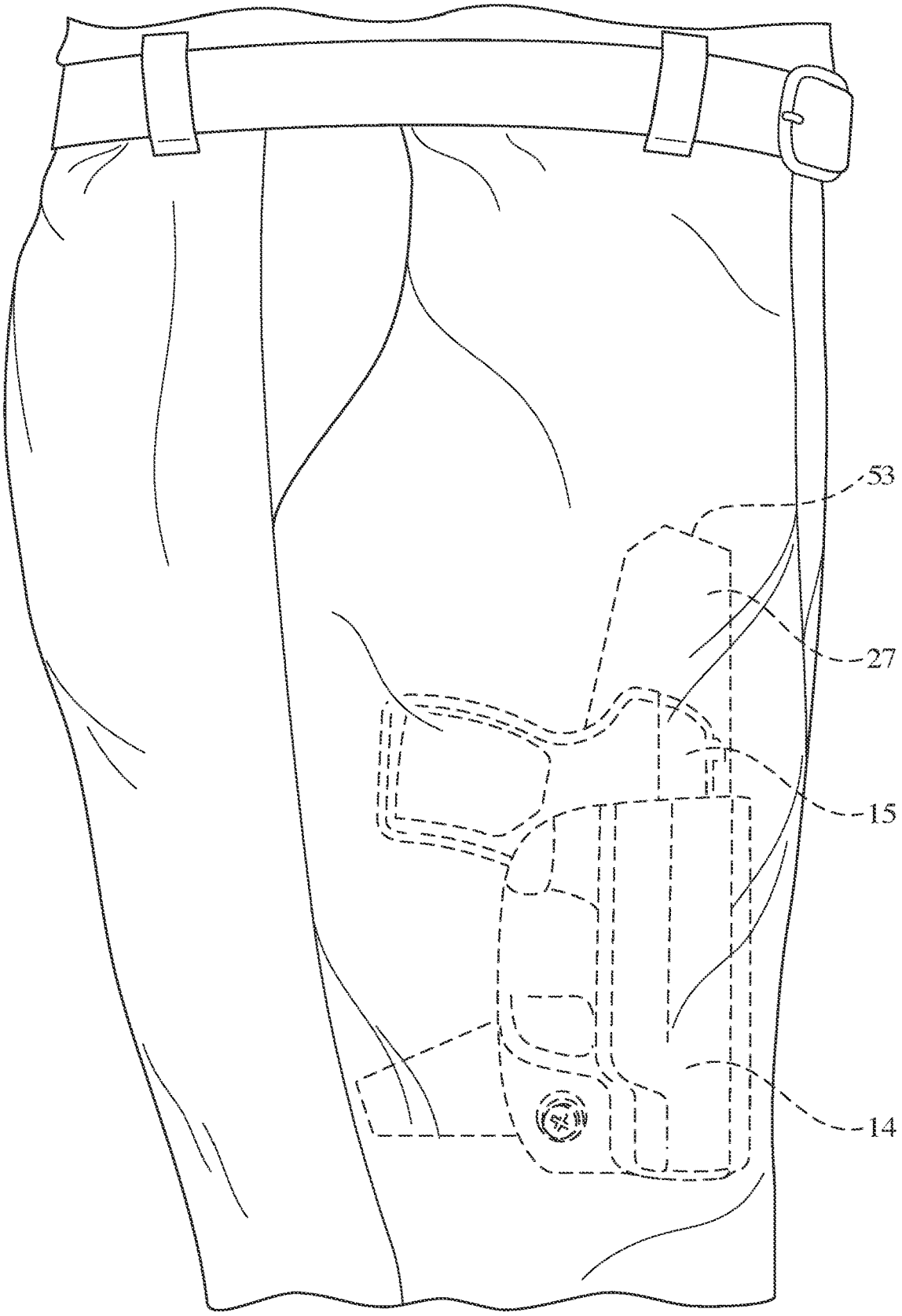
FIG. 13 is an elevational view showing a front pants pocket containing a pocket holster retaining a gun and an L-shaped piece secured to the pocket holster all in a resting position.
Figure 14:
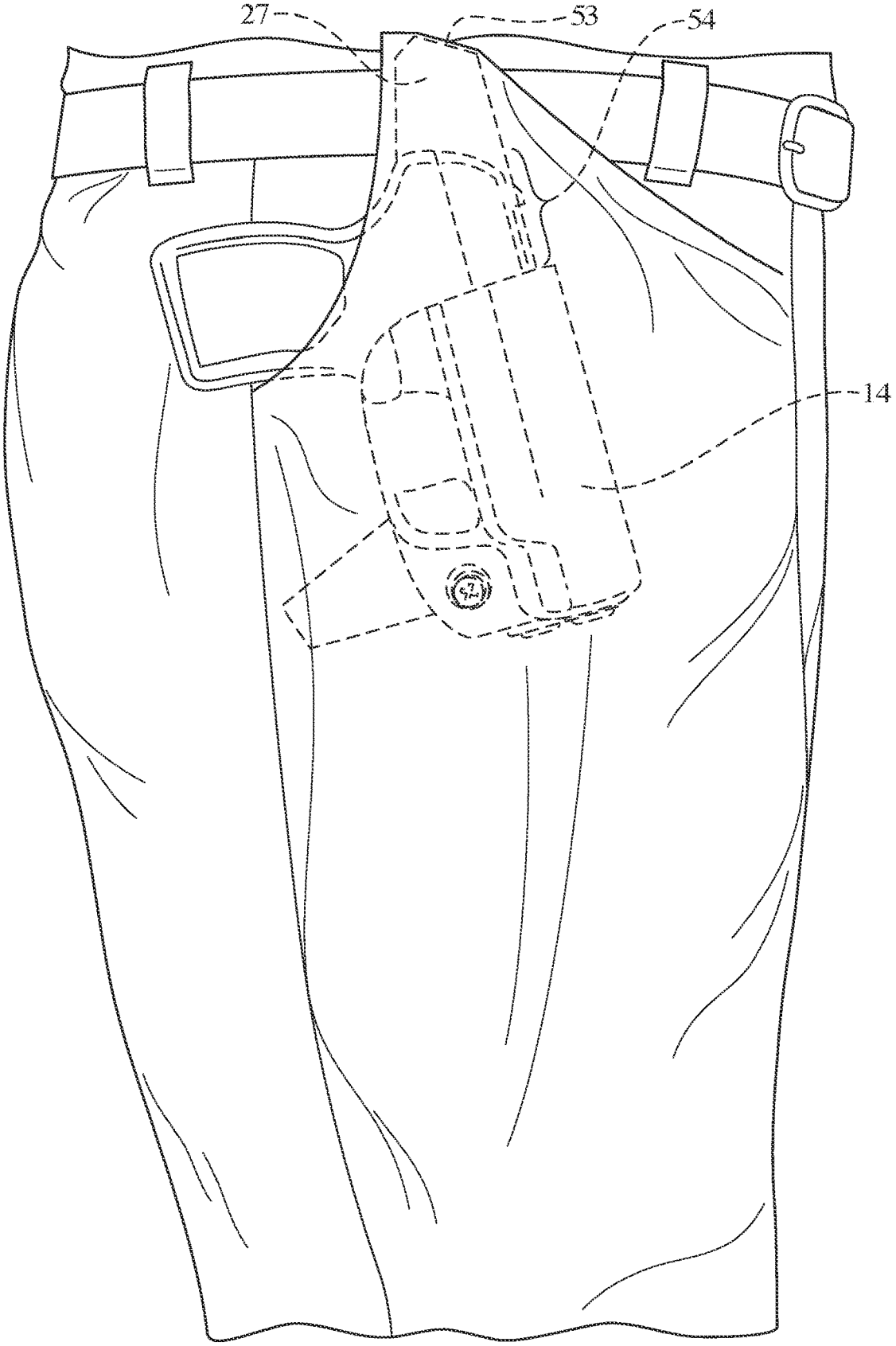
FIG. 14 is an elevational view showing the front pants pocket of FIG. 13 containing the pocket holster retaining the gun at the moment when the holster gun retention is broken as a consequence of a distal end of the stem of the L-shaped piece colliding with a top of the inside of the pocket as a result of the gun beginning the process of being drawn out of the holster.
Figure 15:
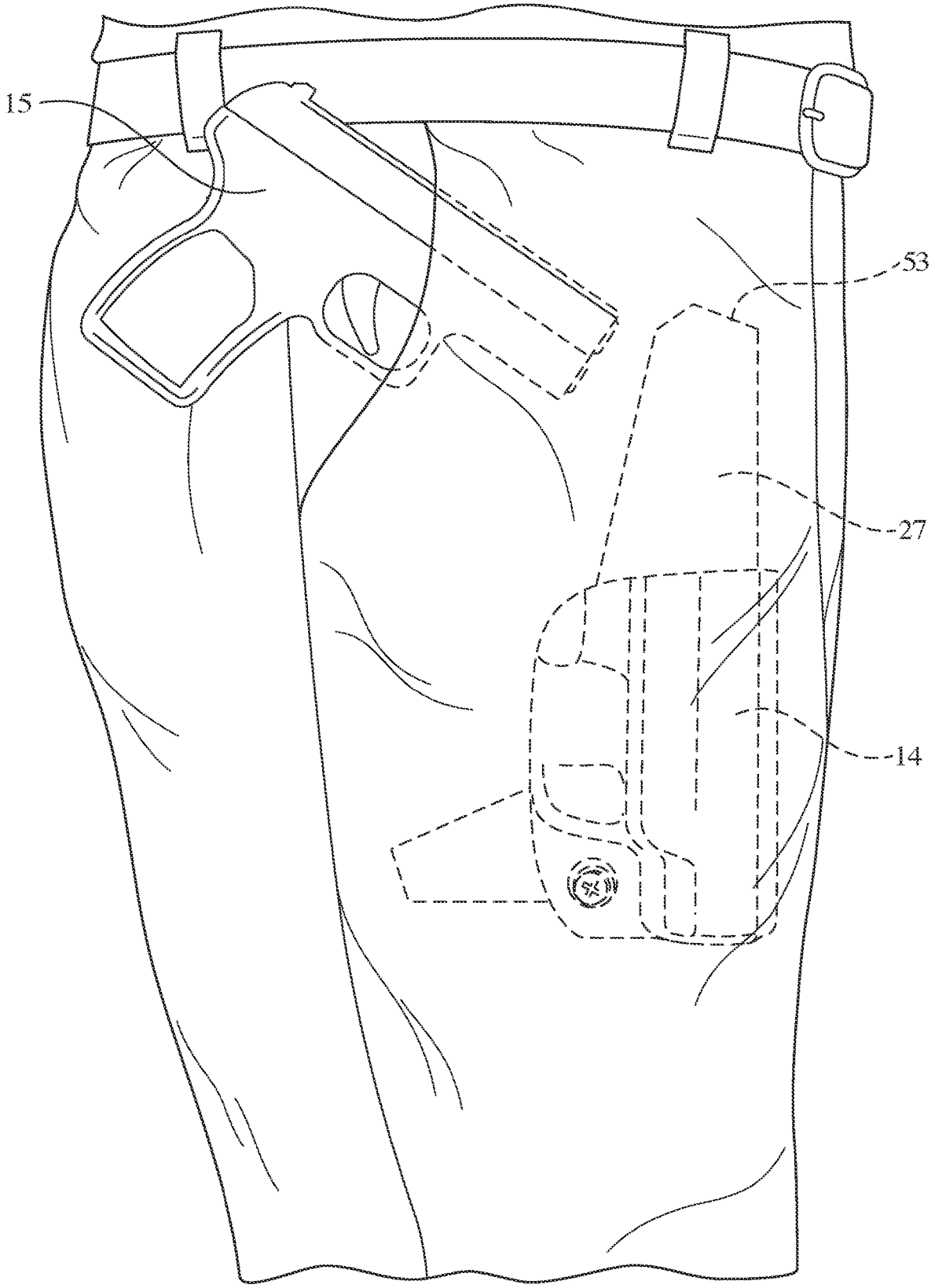
FIG. 15 is an elevational view of the front pants pocket of FIGS. 13 and 14 subsequent to breaking of the retention pursuant to FIG. 14 with the gun drawn out of the holster and the holster falling back to the resting portion of FIG. 14 as well as the L-shaped piece.

Turning to FIG. 13-15, the drawing out of the gun 15 from the holster 14 is shown, although the drawing out of the gun 15 from the holster 10 (FIGS. 1, 5) or the holster 29 (FIG. 8) acts in an analogous manner. A user reaches into the front pants pocket and grasps the gun handle 25 with their hand (not shown) and then applies manual force to retrieve the gun by trying to draw out the gun 15 and in so doing initially lifts or raises the gun 15 and its holster 14 together. Since the gun 15 is retained within the holster 14, breaking that retention is carried out by engaging (or colliding) the distal end 53 of the extension with the top of the inside of the front pants pocket. The distal end 53 is situated more than a clearance distance away from the mouth of the holster 14. Once the retention is broken, the holster 14 falls back down in the front pants pocket to where it was. The clearance distance 54 is of sufficient clearance to accommodate movement of the gun unobstructed by the pants pocket as the gun is drawn out of the pants pocket.

All of the embodiments of FIGS. 1-15 reveal a retention-breakage device that prevents a holster from leaving a pants pocket as a gun is being drawn out of the holster. The embodiments each provide for a holster that has a mouth to accommodate placement of a gun in a manner that, in cooperation with either a trigger guard, closed strap or clip, give rise to retention of the gun in the holster. A retention breaking means is provided that includes an extension for breaking retention of the gun by the holster in response to a collision of a distal end of the extension with an interior surface of a pants pocket. The extension is configured to resist entering into a bent condition from the collision and to resist entering into a collapsed condition from the collision so that a shape of the extension remains unaffected by the collision. The extension extends beyond a periphery of the mouth of the holster to terminate at the distal end that is situated more than a clearance distance away from the mouth. As the gun is being drawn out of the holster after the breaking of the retention, the clearance distance of the extension provides sufficient clearance to accommodate movement of the gun in a manner unobstructed by the pants pocket.

Likewise, all the embodiments of FIGS. 1-15 reveal a method that prevents a holster from leaving a pants pocket as a gun in the holster is being drawn from a holster. The method includes placing a gun into a mouth of a holster in a manner that, in cooperation with a trigger guard, closed strap or clip, gives rise to retention of the gun by the holster. Further, an extension of a retention breaking means projects beyond a periphery of the mouth of the holster to terminate at the distal end that situated is more than a clearance distance away from the mouth or the gun. The retention of the gun by the holster breaks in response to a collision of a distal end of an extension with an interior surface of a pants pocket. The extension resists entering into a bent condition and resists entering into a collapsed condition as the distal end of the extension collides with the interior surface of the pants pocket. The shape of the extension remains unaffected by the collision. As the gun is being drawn out of the holster after the breaking of the retention, the clearance distance provides sufficient clearance to accommodate movement of the gun in a manner unobstructed by the pants pocket.

The extension preferably has an L-shape that has a stem and an arm that extend obliquely away from each other. The extension lacks a projecting hook and lacks a projecting snag whose presence might otherwise snag, hook or catch into the interior surface of the pants pocket as the distal end 53 engages or collides with the top of the interior surface of the pants pocket. Instead, all that is needed is a sturdy distal end of the extension that collides or engages with the interior surface of the pants pocket without snagging or catching into it. The stem and the arm of the L-shape each have portions that taper as they extend away from each other although the stem may also have a proximal portion that widens as it extends toward a distal portion that tapers.

The extension may be fastened to the holster with screw fasteners in which case the holster is made of a rigid plastic material that is fitted onto the gun in a manner that effects the retention of the gun within the holster via a trigger guard so that manual shaking of the holster does not break the retention. Otherwise, the holster and the extension may have respective strips of material that engage each other, such as fibrous hooks and loops or else mushroom head shapes.

The holster may instead be made of a fabric material that is softer than the rigid plastic material in which case the extension is secured to the holster by providing each with the respective strips of material that engage each other, i.e., fibrous hooks and loops or else mushroom head shapes. A clip is secured in a manner that presses the fabric material in a vicinity of the gun trigger to effect the retention of the gun within the holster. Manual shaking of the holster with the clip secured but manual shaping of the holster without the clip secured allows the gun to leave the holster.

The holster and the retention breaking means (i.e., an extension) may be contiguous with each other and/or the holster includes both the extension of the retention breaking means and a retention region in which case the retention region bounds a space and is configured to retain the gun in the space. Thus, passing the gun through the mouth opening in the holster from outside the holster causes the gun to enter into the space.

Since there is some thickness to the holster and the attachment, the base of the attachment fills out the front pants pocket almost completely. As a consequence, there is a snug fit at the base side to side. Both the front of the attachment and the wing on the base of the attachment touch the sides of the pocket. It's because of this that the gun can always be depended on to be in the correct upright orientation when the user goes to draw.

The application mentions repeatedly about the extension making collision with a "top of the inside surface of the pants pocket". The reference to "top" pertains to the relative position of a portion of the pants pocket as the wearer is standing upright. The reference to "inside surface" refers to the pants fabric, which may be considered a combination of the pocket lining (if any) backed by the sturdier pants fabric that either surrounds the pocket lining or is at the waistline of the pants. The collision force arises because of the sturdier pants fabric blocking continued upward movement of the extension at the top of the pants pocket.

While the foregoing description and drawings represent the preferred embodiments of the present invention, various changes and modifications may be made without departing from the scope of the present invention.

What is claimed is:

1. An apparatus that prevents a holster from leaving a pants pocket as a gun in the holster is being drawn out from the holster, comprising:

retention breaking means for breaking retention of the gun in the holster by a force imposed from a collision of a distal end of an extension with the pants pocket;

wherein the distal end of the extension is positioned beyond a periphery of to a mouth of the holster and spaced away from a muzzle of the gun in the holster by a distance exceeding that of a full length of the gun in the holster so as to provide a clearance distance that is sufficient for the gun to be drawn out from the holster unobstructed by the pants pocket;

wherein a shape of the extension remains unchanged as the force of the collision is imposed upon the extension and the shape becomes neither deformed, collapsed, nor broken from the force of the collision;

wherein the retention breaking means has an L shape that is configured and arranged without any snag member and without any hook that might otherwise catch into or snag the interior surface of the pants pocket as the distal end collides with the interior surface of the pants pocket, the L-shape having a stem and an arm each with tapering portions that taper while extending in respective directions away from each other, the stem being the extension; and wherein the L-shape also has a widening portion that widens as the widening portion extends toward the tapering portion of the stem and away from the arm.

2. The apparatus of claim 1, wherein the retention breaking means includes a slot; further comprising:

mechanical fasteners that extend from the slot to secure the retention breaking means and the holster to each other.

3. The apparatus of claim 2, wherein the retention of the gun by the holster is such that the retention withstands manual shaking back and forth of the holster without the retention breaking.

4. The apparatus of claim 1, further comprising:

a fabric extending from the holster that covers a trigger region of the gun; and a clip that is retained by the holster and exerts pressure upon the trigger region of the gun to retain the holster to the gun.

5. The apparatus of claim 3, further comprising:

means for releasably securing to each other the retention breaking means and the holster, the means for releasably securing including interlocking portions of two fastener tapes that releasably join to each other, each of the two fastener tapes having releasably engaging material selected from the group consisting of fibrous hooks and loops that releasably engage each other and fibrous mushroom head shapes that releasably engage each other.

6. The apparatus of claim 1, wherein the holster includes both the extension and a retention region, the retention region bounding a space and is configured to effect the retention of the gun in the space of the retention region so that as the gun sits in the space of the retention region of the holster, the sufficient clearance distance is of a dimension sufficient for a butt of the gun to be drawn out of the holster unobstructed by the pants pocket.

7. The apparatus of claim 6, further comprising:

a strap that extends from the holster to terminate at a free end region; and means for releasably retaining the free end region of the strap to the holster with the strap wrapping across a region of the holster that accommodates a trigger region of the gun therein.

8. A method that that prevents a holster from leaving a pants pocket as a gun in the holster is being drawn out from the holster, comprising the steps of:

breaking retention of a gun in the holster by imposing a force from a collision by a distal end of an extension with the pants pocket;

positioning the distal end of the extension beyond a periphery of to a mouth of the holster and spaced away from a muzzle of the gun in the holster by a distance exceeding that of a full length of the gun in the holster so as to provide a clearance distance that is sufficient for the gun to be drawn out of the holster unobstructed by the pants pocket;

configuring the extension to have a shape that remains unchanged from the force of the collision and becomes neither deformed, collapsed, nor broken because of the force from the collision; and further comprising: providing the L-shape with a widening portion that widens as the widening portion extends toward the tapering portion of the stem and away from the arm.

9. The method of claim 8, further comprising:

providing the retention breaking means with an L-shape without any snag member or hook that might otherwise catch into or snag the interior surface of the pants pocket as the distal end collides with the interior surface of the pants pocket, the L-shape having a stem and an arm each with tapering portions that taper while extending in respective directions away from each other, the stem being the extension.

10. The method of claim 8, further comprising:

providing the holster with a slot; and extending mechanical fasteners from the slot to secure the retention breaking means and the holster to each other.

11. The method of claim 8, wherein the retention of the gun by the holster withstands manual shaking back and forth of the holster without the retention breaking.

12. The method of claim 11, further comprising:

covering a trigger region of the gun with fabric of the holster; and retaining a clip by the holster and arranging the clip to exert pressure on the fabric over the trigger region of the gun to retain the holster to the gun.

13. The method of claim 8, further comprising:

releasably securing to each other the retention breaking means and the holster, the releasably securing including releasably joining interlocking portions of two fastener tapes to each other, each of the two fastener tapes having releasably engaging material selected from the group consisting of fibrous hooks and loops that releasably engage each other and fibrous mushroom head shapes that releasably engage each other.

14. The method of claim 8, wherein the holster includes both the extension and a retention region, the retention region bounding a space and retaining the gun in the space of the retention region so that as the gun sits in the space of the retention region of the holster, the sufficient clearance distance is of a dimension sufficient for a butt of the gun to be drawn out of the holster unobstructed by the pants pocket.

15. The method of claim 14, further comprising:

extending a strap from the holster to terminate at a free end region; and releasably retaining the free end region of the strap to the holster with the strap wrapping across a region of the holster that accommodates a trigger region of the gun therein.

16. A method that prevents a holster from leaving a pants pocket as a gun in the holster is being drawn out from the holster, comprising the steps of:

breaking retention of a gun by the holster with a force resulting from a collision of a distal end of an extension with the pants pocket, positioning the distal end of the extension beyond a periphery of to a mouth of the holster and spaced away from a muzzle of the gun in the holster by a distance exceeding that of a full length of the gun in the holster so as to thereby provide a clearance distance that is sufficient for the gun to be drawn out of the holster unobstructed by the pants pocket;

configuring the extension to have a shape that remains unchanged from the force of the collision and becomes neither deformed, collapsed, nor broken because of the force from the collision; and further comprising: providing the retention breaking means with an L-shape without any snag member or hook that might otherwise catch into or snag the interior surface of the pants pocket as the distal end collides with the interior surface of the pants pocket, the L-shape having a stem and an arm each with tapering portions that taper while extending in respective directions away from each other, the stem being the extension.

17. The method of claim 16, wherein the holster includes both the extension and a retention region, the retention region bounding a space and retaining the gun in the space of the retention region so that as the gun sits in the space of the retention region of the holster, the sufficient clearance distance is of a dimension sufficient for a butt of the gun to be drawn out of the holster unobstructed by the pants pocket.

18. The method of claim 16, further comprising:

covering a trigger region of the gun with fabric of the holster; and retaining a clip by the holster and arranging the clip to exert pressure on the fabric over the trigger region of the gun to retain the holster to the gun.

* * * * *